US006745894B2

(12) United States Patent
Dean

(10) Patent No.: US 6,745,894 B2
(45) Date of Patent: Jun. 8, 2004

(54) WASTE REMOVAL DEVICE

(75) Inventor: Jesse Max Dean, Flint, MI (US)

(73) Assignee: Elizabeth Ann Cummins Dean, Flint, MI (US)

( * ) Notice: Subject to any disclaimer, the term of this patent is extended or adjusted under 35 U.S.C. 154(b) by 147 days.

(21) Appl. No.: 09/931,976

(22) Filed: Aug. 20, 2001

(65) Prior Publication Data

US 2002/0023850 A1 Feb. 28, 2002

Related U.S. Application Data

(60) Provisional application No. 60/226,832, filed on Aug. 22, 2000.

(51) Int. Cl.[7] ..... B65D 81/26

(52) U.S. Cl. ..... 206/204; 206/440; 294/1.3

(58) Field of Search ..... 206/216, 440, 206/204; 15/209.1, 227; 2/16, 161.6; 150/154; 294/1.3

(56) References Cited

U.S. PATENT DOCUMENTS

| | | | | |
|---|---|---|---|---|
| 3,062,371 A | * | 11/1962 | Patience | 206/440 |
| 3,446,525 A | | 5/1969 | Jones | 294/19 |
| 3,971,503 A | | 7/1976 | Allan et al. | 229/38 |
| 3,978,540 A | | 9/1976 | Peck et al. | 15/104.8 |
| 3,984,139 A | | 10/1976 | Battaglia | 294/19 |
| 3,986,744 A | | 10/1976 | Krogstad et al. | 294/55 |
| 4,019,768 A | | 4/1977 | Niece | 294/19 |
| 4,071,921 A | | 2/1978 | Jury | 15/227 |
| 4,078,838 A | | 3/1978 | Nadratowski | 294/19 |
| 4,103,952 A | | 8/1978 | Thompson | 294/1 |
| 4,132,442 A | | 1/1979 | Larsson | 294/25 |
| 4,138,153 A | | 2/1979 | Brown | 294/1 |
| 4,156,400 A | | 5/1979 | Migdal | 119/1 |
| 4,186,955 A | | 2/1980 | Campbell | 294/1 |
| 4,205,869 A | | 6/1980 | Mathis | 294/1 |
| 4,213,528 A | * | 7/1980 | Kreutz et al. | 206/205 |
| 4,215,886 A | | 8/1980 | Naderi et al. | 294/1 |
| 4,215,888 A | | 8/1980 | Gavin et al. | 294/2 |
| 4,221,415 A | | 9/1980 | Ganz | 294/1 |
| 4,230,354 A | | 10/1980 | Claras | 294/1 |
| 4,252,356 A | | 2/1981 | Tokuzumi | 294/1 |

(List continued on next page.)

FOREIGN PATENT DOCUMENTS

FR 2643662 2/1989

*Primary Examiner*—Jacob K. Ackun, Jr.
(74) *Attorney, Agent, or Firm*—Howard & Howard

(57) ABSTRACT

A waste removal device for collecting waste material is disclosed. The waste removal device comprises a first sheet having an inner surface and a second sheet attached to the first sheet and overlying the inner surface to define an envelope for storing the waste material. The waste removal device also includes a third sheet made from an absorbent material that overlies the inner surface of the first sheet adjacent to the second sheet. The third sheet is intended to contact the waste material while the waste removal device is being used and the first sheet is intended to provide added protection to a user by protecting the user from the waste material.

4 Claims, 3 Drawing Sheets

U.S. PATENT DOCUMENTS

| | | | | | |
|---|---|---|---|---|---|
| 4,347,931 | A | | 9/1982 | Ginger et al. | 206/438 |
| 4,431,222 | A | | 2/1984 | Rotella | 294/1 |
| 4,458,932 | A | | 7/1984 | Resch | 294/1 |
| 4,477,111 | A | | 10/1984 | Crooks | 294/1 |
| 4,645,251 | A | | 2/1987 | Jacobs | 294/1.3 |
| 4,677,697 | A | | 7/1987 | Hayes | 2/159 |
| 4,715,495 | A | | 12/1987 | Henry | 206/223 |
| 4,752,093 | A | | 6/1988 | Haber et al. | 294/1.3 |
| 4,768,818 | A | | 9/1988 | Kolic | 294/1.3 |
| 4,788,733 | A | | 12/1988 | Lerner | 15/104 |
| 4,800,677 | A | | 1/1989 | Mack | 119/1 |
| 4,815,590 | A | * | 3/1989 | Peppiatt et al. | 206/204 |
| 4,830,419 | A | | 5/1989 | Watanabe | 294/1.3 |
| 4,836,594 | A | | 6/1989 | Spreiter | 294/1.3 |
| 4,852,924 | A | | 8/1989 | Ines | 294/1.5 |
| 4,854,624 | A | | 8/1989 | Baymiller | 294/1.3 |
| 4,927,010 | A | * | 5/1990 | Kannankeril | 206/204 |
| 4,964,188 | A | | 10/1990 | Olson | 15/227 |
| 5,000,500 | A | | 3/1991 | Almog | 294/1.3 |
| 5,037,149 | A | | 8/1991 | Beck | 294/1.3 |
| 5,039,148 | A | | 8/1991 | Brautovich | 294/1.3 |
| 5,149,159 | A | | 9/1992 | Bardes | 294/1.3 |
| 5,178,426 | A | | 1/1993 | David et al. | 294/1.3 |
| 5,196,244 | A | | 3/1993 | Beck | 428/35.2 |
| 5,222,777 | A | | 6/1993 | Clonch | 294/1.3 |
| 5,280,978 | A | | 1/1994 | Bohn | 294/1.3 |
| 5,282,660 | A | | 2/1994 | Halling | 294/1.3 |
| 5,301,806 | A | | 4/1994 | Olson | 206/278 |
| 5,318,334 | A | | 6/1994 | Madrid | 294/1.3 |
| 5,438,708 | A | | 8/1995 | Jacovitz | 2/161.6 |
| 5,564,762 | A | | 10/1996 | Ring | 294/1.3 |
| 5,564,763 | A | | 10/1996 | Mercurio | 294/1.3 |
| 5,568,955 | A | | 10/1996 | Giuliano et al. | 294/1.3 |
| 5,579,812 | A | | 12/1996 | Bigwood | 141/109 |
| 5,634,678 | A | | 6/1997 | Bailey | 294/1.5 |
| 5,643,189 | A | * | 7/1997 | Masini | 602/58 |
| 5,704,670 | A | | 1/1998 | Surplus | 294/25 |
| 5,797,636 | A | | 8/1998 | Hamynen | 294/1.3 |
| 5,806,668 | A | | 9/1998 | Bixby | 206/216 |
| 5,836,629 | A | | 11/1998 | Hobart | 294/1.3 |
| 5,864,883 | A | | 2/1999 | Reo | 2/158 |
| 5,954,201 | A | * | 9/1999 | Finch et al. | 206/440 |
| 5,961,167 | A | | 10/1999 | Gilley | 294/1.3 |
| 5,964,488 | A | | 10/1999 | Bedel | 294/1.3 |
| 5,987,645 | A | | 11/1999 | Teaster | 2/159 |
| 6,048,008 | A | | 4/2000 | Shaw | 294/1.3 |
| 6,058,882 | A | | 5/2000 | Leutholt | 119/161 |
| 6,102,457 | A | | 8/2000 | Smith | 294/1.3 |
| 6,116,194 | A | | 9/2000 | Komarnitskiy | 119/867 |
| 6,116,668 | A | | 9/2000 | Carpool | 294/1.3 |
| 6,123,046 | A | | 9/2000 | Gemeniano | 119/161 |

* cited by examiner

WASTE REMOVAL DEVICE

RELATED U.S. APPLICATIONS

This application claims the benefit of U.S. provisional application No. 60/226,832, filed on Aug. 22, 2000.

FIELD OF THE INVENTION

The present invention relates to a device for collecting waste material, more specifically, a waste removal device of the type having an absorbent sheet for contacting the waste material and a plastic sheet for protecting the user from the waste material.

BACKGROUND OF THE INVENTION

A common problem with the collection of waste material is the potential contact of the waste material with the user. The majority of the prior art devices have a bag or envelope for receiving a hand of a user. The bag comprises a first sheet and a second sheet sealed together in a conventional manner to form the bag or envelope. In some cases, the waste removal device further includes a third sheet attached to an outer surface of the first sheet for contacting the waste material. The third sheet is made from an absorbent material for facilitating the collection of the waste material. In such a configuration, the user places a hand within the bag and grabs or wipes the waste material. In so doing, the third sheet contacts the waste material and the first sheet provides a barrier between the user's hand and the waste material being collected.

An example of such a prior art device is disclosed in U.S. Pat. No. 5,987,645 to Teaster granted Nov. 23, 1999 wherein an envelope defined by a first sheet and a second sheet and in the shape of a mitt protects a user from the waste material being collected. The user places a hand in the mitt and proceeds to collect the waste material with the first and second sheets providing a barrier between the user's hand and the waste material. Here, the first and second sheets could be made from a plastic material or an absorbent material, however, there is no added protection for the user should the first or second sheets be made from an absorbent material. If the first or second sheets were made from an absorbent material, a waste material with a high liquid content would likely absorb through the absorbent sheet. Hence, the user's hand would come into contact with the waste material.

Furthermore, U.S. Pat. No. 5,864,883 to Reo granted Feb. 2, 1999 discloses a bag defined by a first sheet and a second sheet for receiving a hand of the user and having a third sheet made from tissue paper attached to an outer surface of the first sheet. After use, the bag of the '883 patent is inverted to create a barrier between the used tissue paper and the user. The invention of the '883 patent to Reo, however, requires an unnecessary amount of material to manufacture. The second sheet attached to the first sheet provides little added utility to the device. The second sheet's primary function is to provide a barrier between the waste material and the user after the waste material has been collected and the bag is inverted.

Therefore, there is a need in the art to provide a simplified waste removal device that protects a user's hand and provides absorbancy, yet is simple to use and employs a minimum amount of material.

SUMMARY OF THE INVENTION AND ADVANTAGES

The waste removal device of the present invention comprises a first sheet having an inner surface and a second sheet attached to the first sheet and overlying the inner surface to define an envelope for storing the waste material. The waste removal device further includes a third sheet made from an absorbent material that overlies the inner surface of the first sheet adjacent to the second sheet.

Accordingly, the present invention reduces the amount of material required to protect the user from the waste material. In the present invention, once the waste material is collected, the first and third sheets are simply wrapped around the waste material and rolled into the envelope to secure the waste material for disposal.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Referring to the Figures, wherein like numerals indicate like or corresponding parts throughout the several views, a waste removal device for collecting waste material is generally shown at 10. The waste removal device 10 is for collecting the waste material and shielding a user from the waste material. The device 10 could be utilized for a multitude of purposes, including, but not limited to, collecting feces of a dog while the user and the dog participate in recreational activities, cleaning kitchen surfaces, use as a toiletry while camping, used to care for children and invalids, cleaning spills, and so on. It is to be understood, however, that the use is not intended to limit the present invention.

Figure 1:
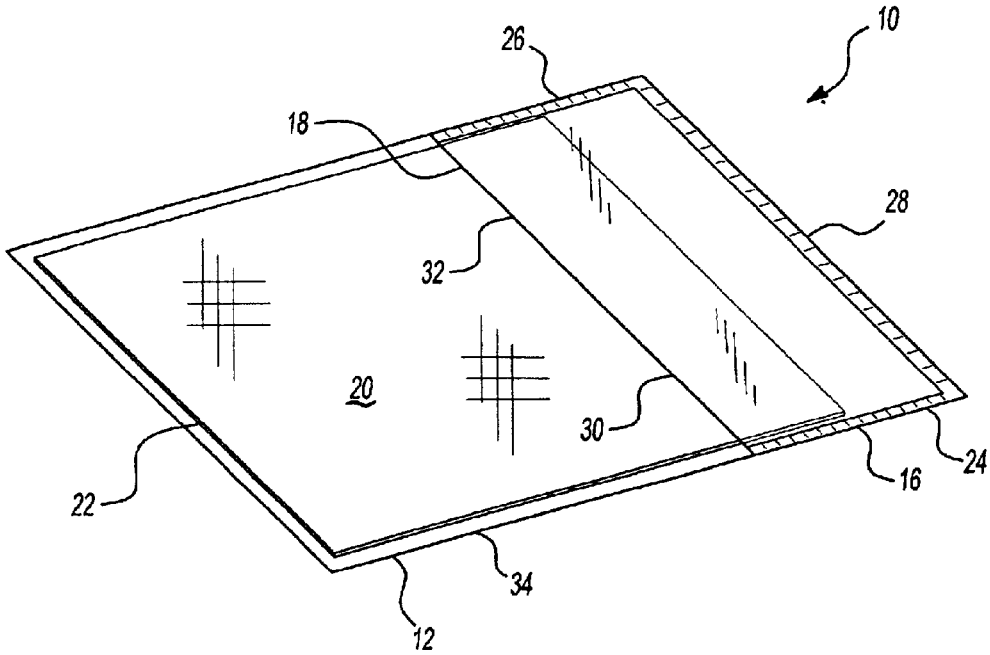
FIG. 1 is a perspective view of a waste removal device embodying the present invention.
Figure 2:
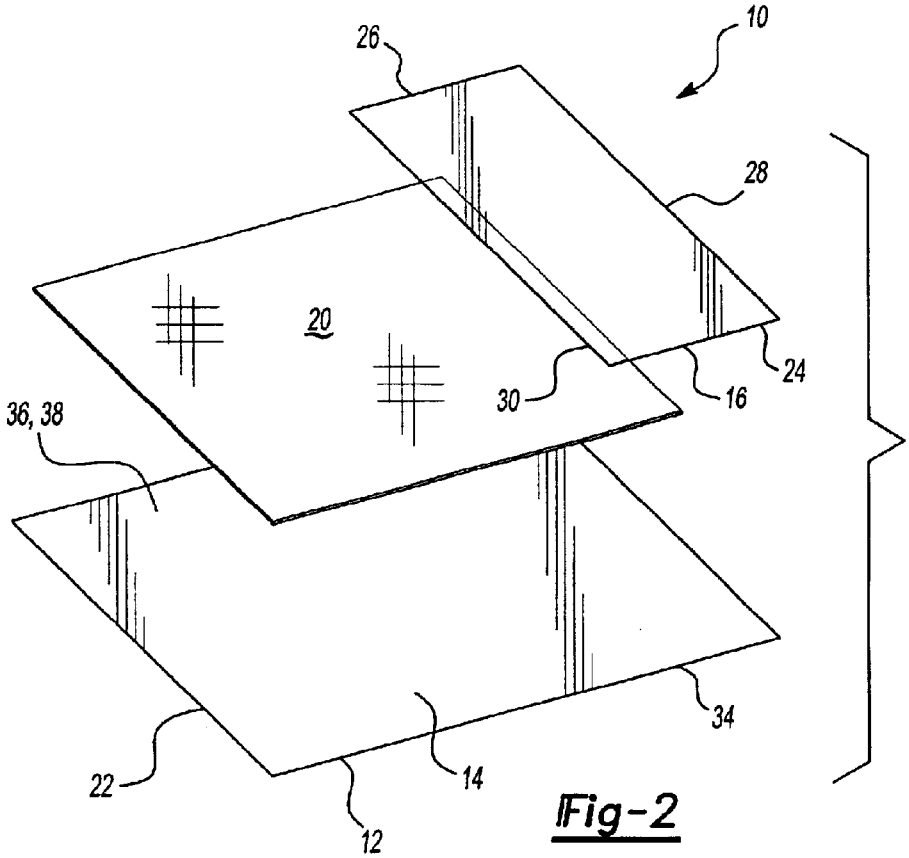
FIG. 2 is an assembly view of the waste removal device.

Referring to FIG. 1 and FIG. 2, the waste removal device 10 comprises a first sheet 12 having an inner surface 14 and a second sheet 16 attached to the first sheet 12 and at least partially overlying the inner surface 14. The first sheet 12 and the second sheet 16 define an envelope 18 for storing the waste material. A third sheet 20 made from an absorbent material overlies the inner surface 14 of the first sheet 12 adjacent to the second sheet 16. In the preferred embodiment, the third sheet 20 is attached to the first sheet 12. It is to be understood, however, that the third sheet 20 could also be practiced such that the third sheet 20 is attached in some fashion to the second sheet 16.

The third sheet 20 extends into the envelope 18 defined by the first and second sheets 12,16. The third sheet 20 is flexible to facilitate collection of the waste material. In the preferred embodiment, the third sheet 20 is affixed by gluing, heat sealing or other method of attachment to one of the first and second sheets. More specifically, the first sheet 12 further includes a first end 22 spaced from atop edge 30 of the second sheet 16 and the third sheet 20 is affixed by gluing, heat sealing or other method of attachment to the first sheet 12 at the first end 22. By having the absorbent sheet attached only at the top, the device remains soft and flexible so that it can easily encompass the waste material and allow the waste material to be wrapped and manipulated into the envelope 18. It is to be understood, however, that the third sheet 20 could be attached to any portion of the first sheet 12. The attachment of the third sheet 20 is not intended to limit the present invention. The third sheet 20 may be attached to one of the first and second sheets 12,16 by any conventional method including, but not limited to, pressure sealing, heat sealing, stitching, and so on.

The third sheet 20 is made from absorbent cellulosic material such as soft, crushable paper with properties common to paper toweling and facial tissue, which facilitates clinging to soft, moist substances.

The first and second sheets 12,16 are flexible and made from plastic. In the preferred embodiment, the first and second sheets 12,16 are made from a clear, lightweight plastic such as that used for plastic sandwich bags and the like. It is to be understood, however, that the first and second sheets can be made from any material including, but not limited to paper, plastic, or other moisture impervious materials. The first and second sheets 12,16 are heat sealed together about the peripheries thereof to form the envelope 18. Heat sealing is only one conventional method that can be used to connect the first and second sheets 12,16. Other conventional methods could also be used, such as, but not limited to, gluing, pressure sealing, stitching and so on. The second sheet 16 further includes first and second side edges 24,26 and a third bottom edge 28 wherein the second sheet 16 is heat sealed to the inner surface 14 of the first sheet 12 along the first and second side edges 24,26 and the third bottom edge 28 to form the envelope. The top edge 30 of the second sheet 16 and the inner surface 14 of the first sheet 12 define an opening 32 of the envelope 18 for guiding the waste material into the envelope 18. In the preferred embodiment, the waste removal device 10 is very lightweight and highly flexible and is intended to be a single-use, disposable device.

In alternative embodiments of the present invention, the first and second sheets 12, 16 can be integrally formed together while retaining the remaining features of the preferred embodiment. In one alternative embodiment, shown in FIG. 3*a*, the first and second sheets integrally form a continuous sheet 33 such that only the first and second side edges 24, 26 require heat sealing. The third bottom edge 28 in this alternative embodiment represents a fold line 35 of the continuous sheet 33 separating the continuous sheet 33 into the first and second sheets 12, 16.

Figure 3:
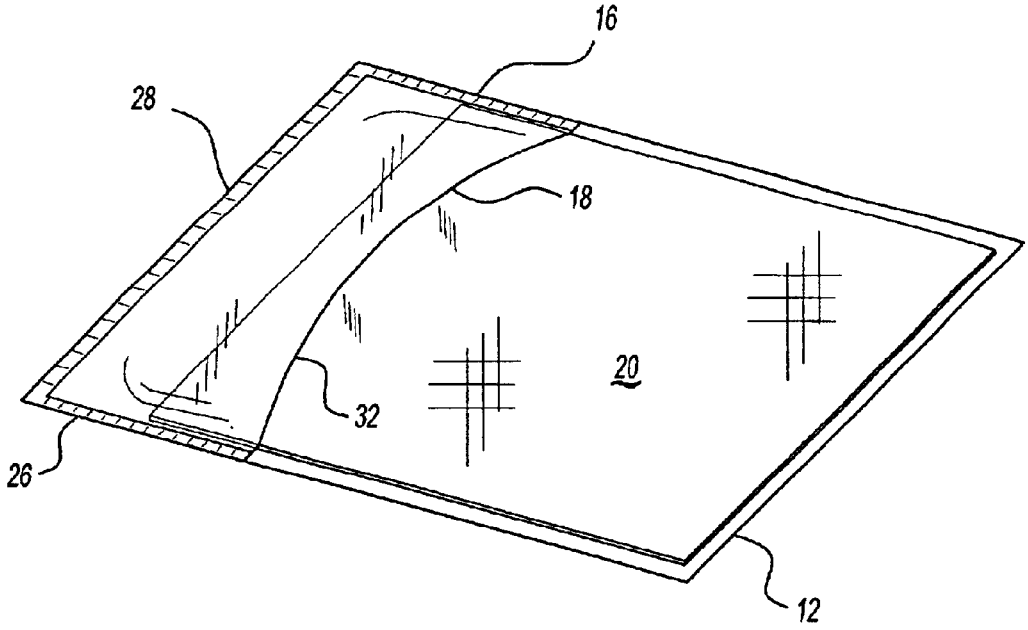
FIG. 3 is a perspective view of the waste removal device illustrating an opening of an envelope of the waste removal device.
Figure 3A:
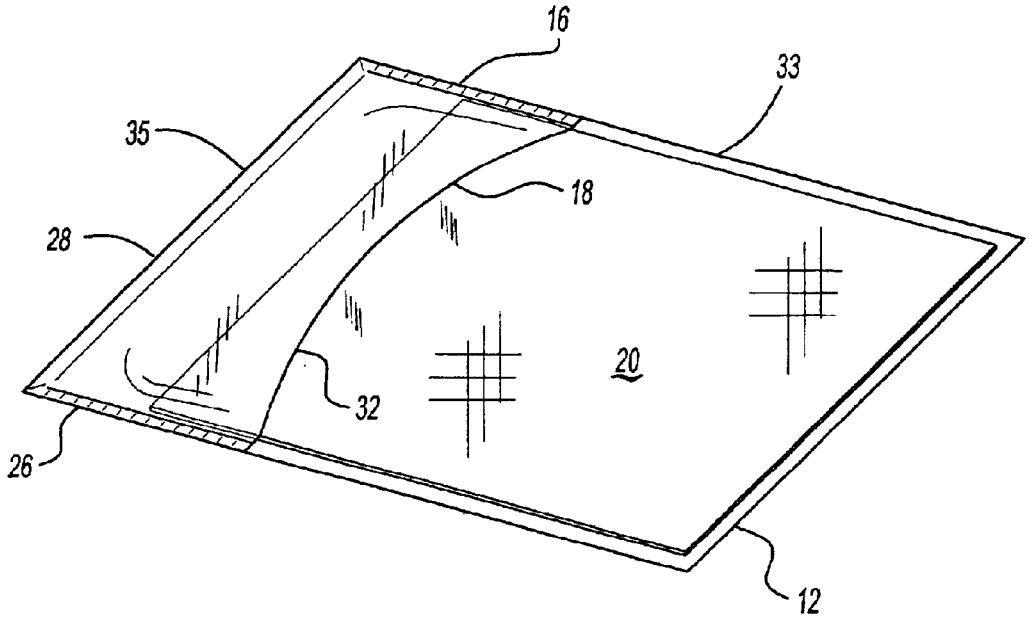
FIG. 3*a* is a perspective view of an alternative embodiment of the waste removal device.

In a second alternative embodiment, the first and second sheets 12, 16 are integrally formed together such that no additional connection of the first sheet 12 to the second sheet 16 is necessary. FIG. 3 generally illustrates the second alternative embodiment with the addition of heat sealing at the first and second side edges 24, 26, and the third edge 28. The first and second side edges 24, 26 and the third edge 28 in the second alternative embodiment simply represent fold lines separating the first and second sheets 12, 16. However, heat sealing or other conventional methods may be used at the fold lines to create creases and shape the waste removal device 10.

Further alternative embodiments can be realized by combining two or more methods of connecting the first and second sheets 12, 16. It is to be understood, however, that the connection of the first and second sheets 12, 16 is not intended to limit the present invention.

The first and second side edges 24,26 are of substantially equal length. The first sheet 12 includes a longitudinal edge 34 which, in the preferred embodiment, is at least twice the length of each of the first and second side edges 24,26 of the second sheet 16. In additional embodiments, the longitudinal edge 34 of the first sheet 12 is at least three times the length of each of the first and second side edges 24,26 of the second sheet 16. While it is preferred that the longitudinal edge 34 be at least twice the length of each of the first and second side edges 24,26, this is not intended to limit the present invention.

The first sheet 12 further includes a flap 36 defined by a portion 38 of the first sheet 12 extending from the opening 32 of the envelope 18 to the first end 22 of the first sheet 12.

Figure 4:
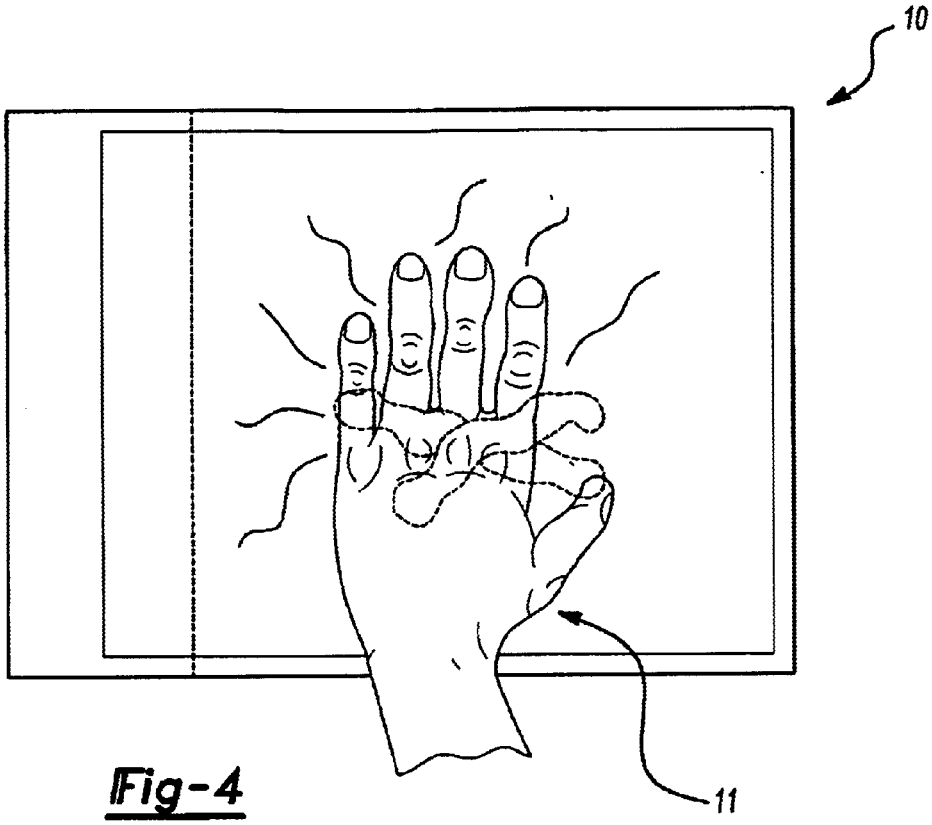
FIG. 4 illustrates the operation of the waste removal device.
Figure 5:
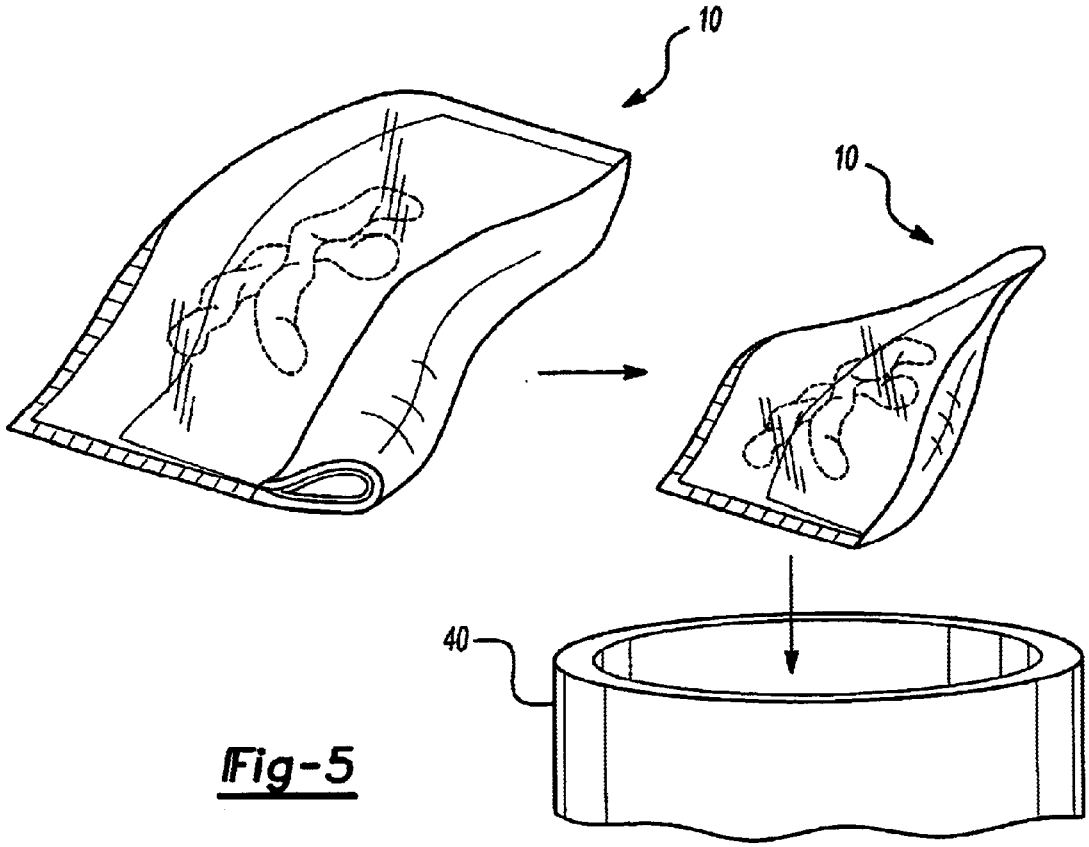
FIG. 5 further illustrates the operation of the waste removal device and subsequent disposal.

Referring to FIG. 4, the user of the device lays the waste removal device 10 over the waste material with the third sheet 20 contacting the waste. The user then manipulates, lifts and rolls the waste material from an opposite side of the flap 36 to maintain a barrier between the absorbent third sheet 20 and a user's hand 11. Referring to FIG. 5, the flap 36 of the first sheet 12 and the absorbent third sheet 20 containing the waste material are then rolled into the envelope 18, rendering the waste material securely wrapped for transport to a nearby waste receptacle 40.

Obviously, many modifications and variations of the present invention are possible in light of the above teachings. The invention may be practiced otherwise than as specifically described within the scope of the appended claims.

What is claimed is:

1. A waste removal device for collecting waste material, said device comprising;

a first sheet having an inner surface, a first end, and a longitudinal edge, a second sheet spaced from said first end and having first and second side edges attached to said first sheet, said second sheet at least partially overlying said inner surface, said longitudinal edge of said first sheet being at least three times a length of said side edges of said second sheet, said first and second sheets defining an envelope having an opening for storing the waste material, and a third sheet made from an absorbent material and affixed to said first end of said first sheet and substantially overlying said inner surface of said first sheet and extending into said opening of said envelope.

2. The device as set forth in claim 1 wherein said third sheet includes a first end affixed to said first end of said first sheet and said third sheet extends to a second end that is unattached in said opening thereby allowing said second end to move within said opening during use.

3. The device as set forth in claim 1 wherein said first and second sheets are made from plastic and are rectangular in configuration and said third sheet is rectangular in configuration.

4. The device as set forth in claim 1 wherein said third sheet is affixed to said first sheet by one of pressure sealing, heat sealing, and stitching.

* * * * *